United States Patent [19]

Hutchison et al.

[11] Patent Number: 4,997,161

[45] **Date of Patent: * Mar. 5, 1991**

[54] FUEL CONTROL SYSTEM THROTTLE VALVE UNIT THEREFOR AND METHODS OF MAKING THE SAME

[75] Inventors: Donald W. Hutchison; Steven A. Kimmel, both of Greensburg; Raymond J. Bonkovich, Mt. Pleasant; James P. Chew, Jeannette; David J. Rath, Mt. Pleasant, all of Pa.

[73] Assignee: Robertshaw Controls Company, Richmond, Va.

[ * ] Notice: The portion of the term of this patent subsequent to May 1, 2007 has been disclaimed.

[21] Appl. No.: 483,571

[22] Filed: Feb. 22, 1990

Related U.S. Application Data

[62] Division of Ser. No. 260,817, Oct. 21, 1988, Pat. No. 4,921,210.

[51] Int. Cl.[5] ..... F16K 31/08

[52] U.S. Cl. ..... 251/129.08; 126/39 E

[58] Field of Search ..... 251/129.08, 129.04, 251/65; 126/39 E

[56] References Cited

U.S. PATENT DOCUMENTS

| | | | |
|---|---|---|---|
| 3,469,590 | 9/1969 | Barker | 251/129.08 X |
| 3,842,809 | 10/1974 | King | 251/129.08 X |
| 4,345,737 | 8/1982 | Kawai et al. | 251/129.08 X |
| 4,391,265 | 7/1983 | Chen | 126/39 E |
| 4,643,394 | 4/1987 | Shimura | 251/129.08 |
| 4,745,515 | 5/1988 | Fowler | 323/235 X |

*Primary Examiner*—Stephen M. Hepperle

*Attorney, Agent, or Firm*—Candor, Candor & Tassone

[57] ABSTRACT

A fuel control system, throttle valve unit therefor and methods of making the same are provided, the system comprising a burner, a source of fuel for the burner, and a throttle valve unit for interconnecting the source to the burner, the throttle valve unit having a movable valve member and a valve seat controlled by the valve member, the throttle associated with the valve member to control the position of the valve member relative to the valve seat so as to control the flame height at the burner, the electrically operated unit comprising a fixed magnet unit and a movable magnet unit each of which is adapted to provide a magnetic field that will react with the other magnetic field, one of the magnet units having an electrical conductor that is adapted to vary the force of its magnetic field in relation to the magnitude of an electrical current passing therethrough whereby the valve member is adapted to be positioned relative to the valve seat in relation to the effect created between the magnetic fields.

8 Claims, 5 Drawing Sheets

FUEL CONTROL SYSTEM THROTTLE VALVE UNIT THEREFOR AND METHODS OF MAKING THE SAME

CROSS REFERENCE TO RELATED APPLICATIONS

This application is a divisional patent application of its copending parent patent application Ser. No. 260,817, filed Oct. 21, 1988, now U.S. Pat. No. 4,921,210.

BACKGROUND OF THE INVENTION

1. Field of the Invention

This invention relates to a new fuel control system and to a new throttle valve unit therefor as well as to methods of making the same, the control system being particularly adapted to be utilized for controlling the operation of a cooking apparatus or the like.

2. Prior Art Statement

It is known to applicants to provide a fuel control system comprising a burner means, a source of fuel for the burner means, and a throttle valve unit for interconnecting the source to the burner means, the throttle valve unit having a movable valve member and a valve seat controlled by the valve member, the throttle valve unit having electrically operated means operatively associated with the valve member to control the position of the valve member relative to the valve seat so as to control the flame height at the burner means.

It is also known to provide a speaker for a radio or the like wherein the magnetic field created by an electrical current passing through a coil of wire reacts with the magnetic field of a permanent magnet to move the coil relative to the permanent magnet and thereby operate the diaphragm of the speaker to create sound waves.

SUMMARY OF THE INVENTION

It is one feature of this invention to provide unique means for electrically positioning the movable valve member of a throttle valve unit relative to its valve seat so as to control the flame height at the burner means being controlled by the throttle valve unit.

In particular, it was found according to the teachings of this invention that the electrically operated means for controlling the position of the movable valve member of a throttle valve unit relative to the valve seat thereof can comprise a fixed magnet means and a movable magnet means each of which is adapted to provide a magnetic field that will react with the other magnetic field and that by having one of the magnet means comprise an electrical conductor means that is adapted to vary the force of its magnetic field in relation to the magnitude of an electrical current passing therethrough, the movable valve member can be accurately positioned relative to the valve seat in relation to the resulting effect created between the magnetic fields by accurately controlling the magnitude of the electrical current that passes through the electrical conductor of the one magnet means.

For example, one embodiment of this invention provides a fuel control system comprising a burner means, a source of fuel for the burner means, and a throttle valve unit for interconnecting the source to the burner means, the throttle valve unit having a movable valve member and a valve seat controlled by the valve member, the throttle valve unit having electrically operated means operatively associated with the valve member to control the position of the valve member relative to the valve seat so as to control the flame height at the burner means, the electrically operated means comprising a fixed magnet means and a movable magnet means each of which is adapted to provide a magnetic field that will react with the other magnetic field, one of the magnet means having electrical conductor means that is adapted to vary the force of its magnetic field in relation to the magnitude of an electrical current passing therethrough whereby the valve member is adapted to be positioned relative to the valve seat in relation to the effect created between the magnetic fields.

Accordingly, it is an object of this invention to provide a new fuel control system having one or more of the novel features of this invention as set forth above or hereinafter shown or described.

Another object of this invention is to provide a new method of making such a fuel control system, the method of this invention having one or more of the novel features of this invention as set forth above or hereinafter shown or described.

Another object of this invention is to provide a new throttle valve unit for a fuel control system, the throttle valve unit of this invention having one or more of the novel features of this invention as set forth above or hereinafter shown or described.

Another object of this invention is to provide a new throttle valve unit for a fuel control system, the throttle valve unit of this invention having one or more of the novel features of this invention as set forth above or hereinafter shown or described.

Another object of this invention is to provide a new method of making such a throttle valve unit, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
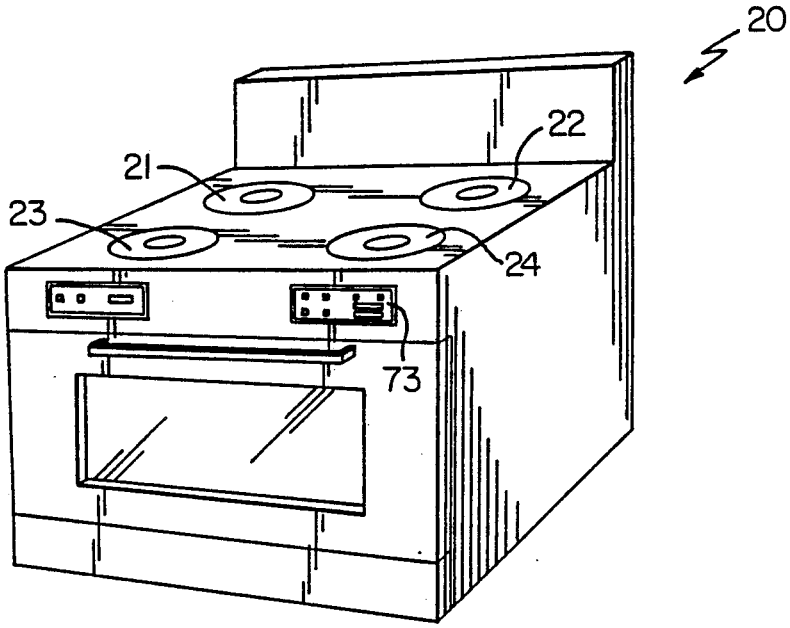
FIG. 1 is a top perspective view of a cooking apparatus that utilizes the new fuel control system of this invention.
Figure 2:
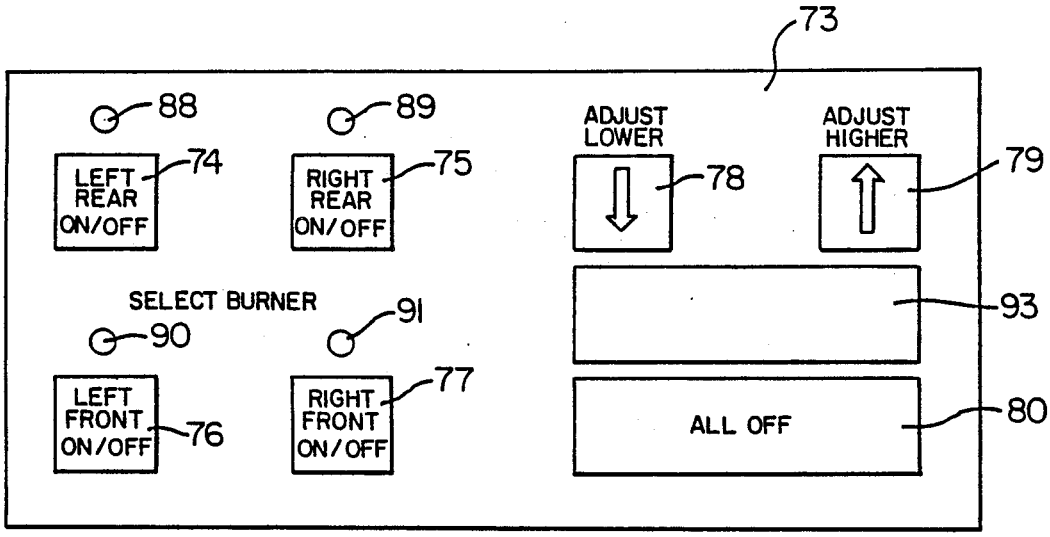
FIG. 2 is an enlarged front view of the control panel of the cooking apparatus of FIG. 1, the control panel of FIG. 2 containing the selector means for operating the fuel control system of this invention.
Figure 3:
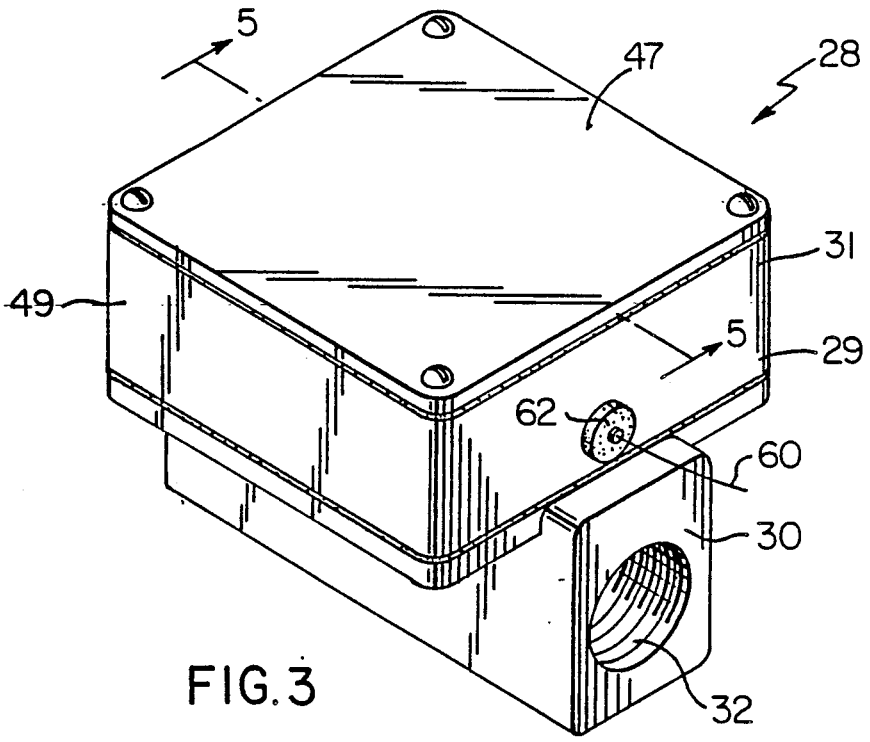
FIG. 3 is a top perspective view of one of the throttle valve units of this invention that is utilized in the fuel control system of this invention.
Figure 4:
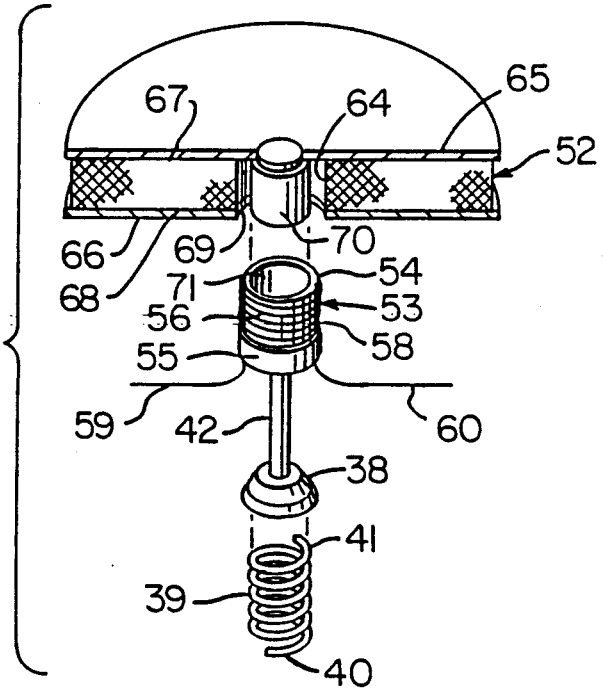
FIG. 4 is an exploded perspective view of certain parts of the throttle valve unit of FIG. 3.

While the various features of this invention are hereinafter illustrated and described as being particularly adapted to provide a fuel control system for controlling a domestic cooking apparatus or the like, it is to be understood that the various features of this invention can be utilized single or in various combinations thereof to provide a fuel control system for controlling other apparatus or appliances as desired.

Therefore, this invention is not to be limited to only the embodiment illustrated in the drawings, because the drawings are merely utilized to illustrate one of the wide variety of uses of this invention.

Referring now to FIG. 1, a typical domestic cooking apparatus is generally indicated by the reference numeral 20 and has four top burners 21, 22, 23 and 24 for burning gaseous fuel in a manner well known in the art for cooking purposes and the like. However, the top burners 21–24 are controlled in a unique manner by the control system of this invention that is hereinafter set forth.

In particular, it is well known that it is desired to provide a throttle valve unit for a top burner that permits the operator of the cooking apparatus utilizing the same to accurately control the height of the flame at the burner means controlled thereby so as to more accurately control the cooking operation being provided thereby, such as for a simmering operation and the like. For example, see the copending patent application of Francis S. Genbauffe, Ser. No. 073,811, filed Jul. 15, 1987, which discloses a mechanically operated throttle valve means that solves this problem by providing for a relatively long rotational movement of the selector means of the throttle valve means between the lowest flame setting position of the burner means being controlled and the highest flame setting position thereof so that the operator has more control in setting the flame height and since this application has now been allowed and has had the issue fee paid therefor, this copending patent application, Ser. No. 073,811, filed Jul. 15, 1987, is being incorporated into this disclosure by this reference thereto.

In contrast, this invention solves this problem by electrically operating a throttle valve means in a unique manner now to be described.

Figure 6:
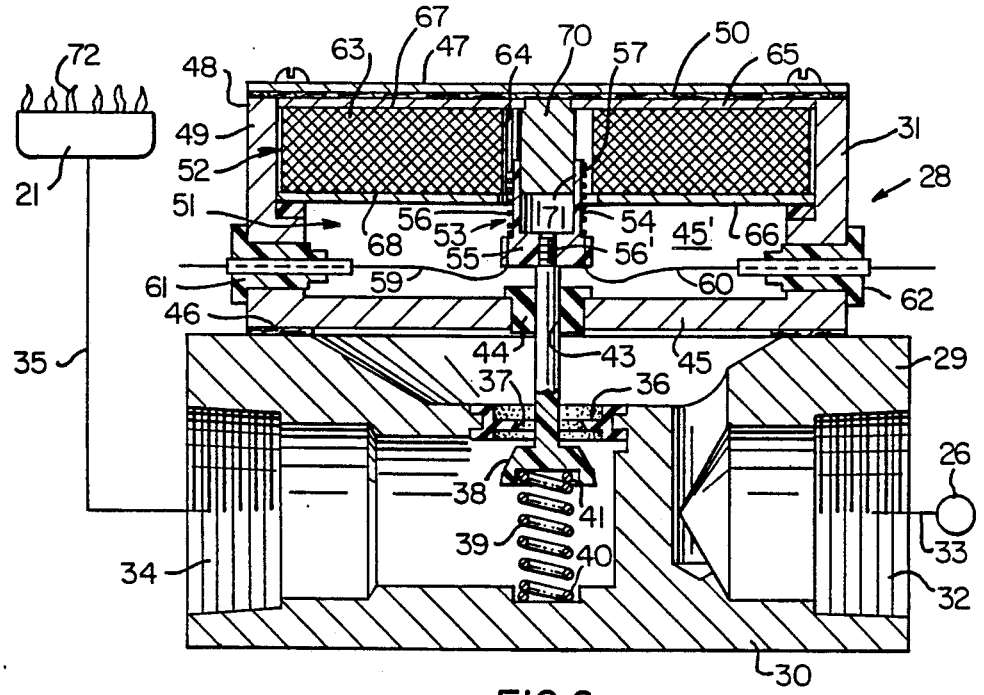
FIG. 6 is a view similar to FIG. 5 and illustrates the throttle valve unit in one of the open positions thereof.
Figure 7:
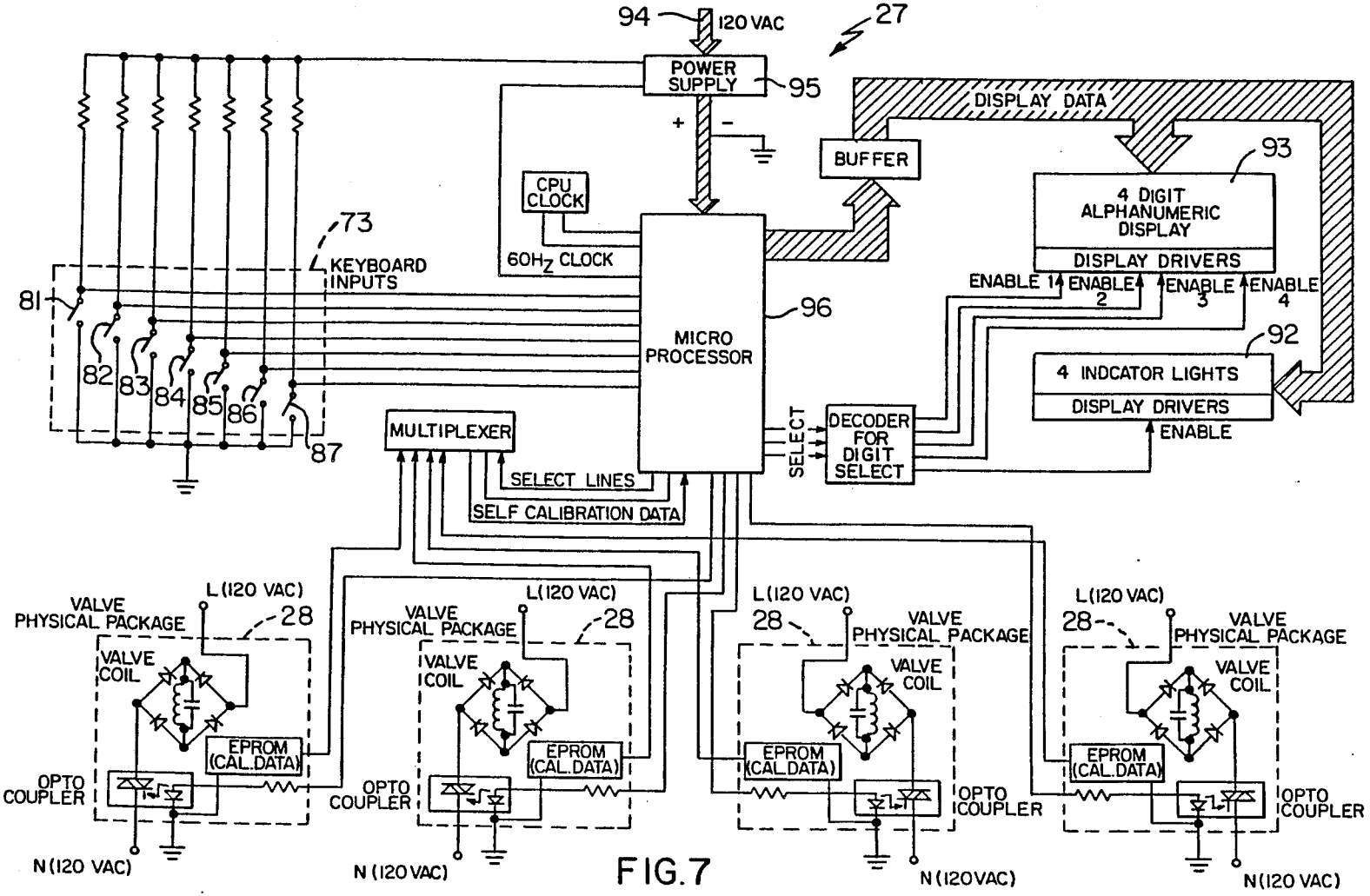
FIG. 7 is a schematic view of the electrical part of the fuel control system of this invention.

The fuel control system of this invention for controlling the top burners 21–24 of the cooking apparatus 20 is generally indicated by the reference numeral 25 throughout the drawings, the control system 25 comprising a fuel source 26 (FIGS. 5 and 6), such as a conventional source of natural or synthetic gas that is normally provided for domestic cooking apparatus and the like, an electrical control circuit means that is generally indicated by the reference numeral 27 in FIG. 7, the top burner means 21–24, and a plurality of throttle valve units that are each generally indicated by the reference numeral 28.

While the system 25 of this invention includes four throttle valve units 28 respectively for the four top burners 21–24, only one such throttle valve unit 28 is in FIGS. 3–6 with the understanding that each burner means 21–24 would be provided with a like throttle valve unit 28 that is operated in the same manner as the throttle valve 28 illustrated in FIGS. 5 and 6 and hereinafter described.

Figure 5:
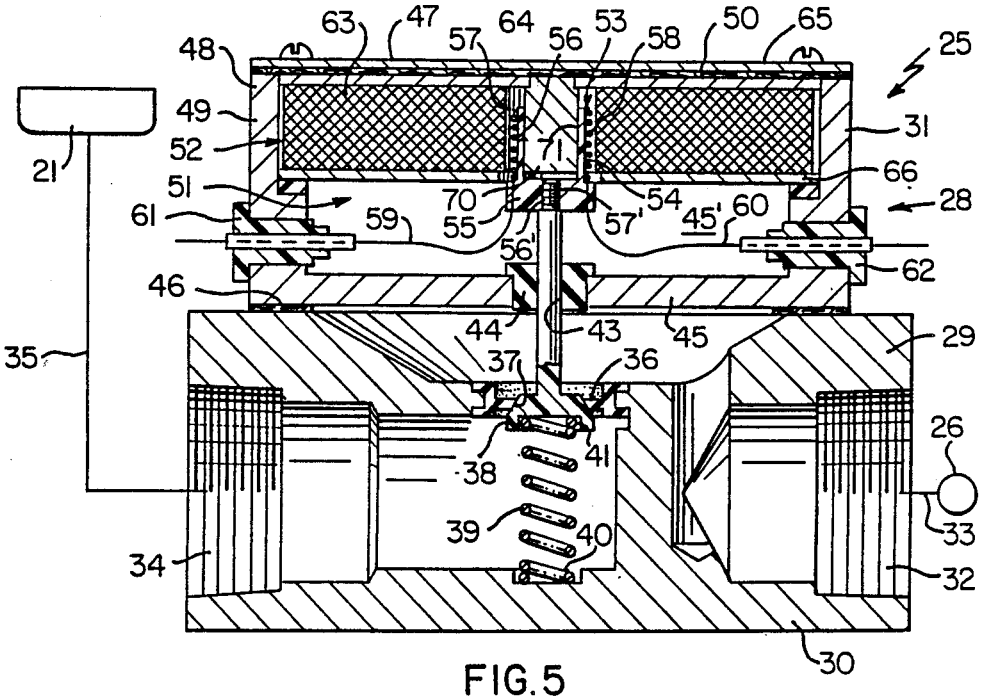
FIG. 5 is an enlarged cross-sectional view taken on line 5—5 of FIG. 3, FIG. 5 schematically illustrating the throttle valve unit being adapted to interconnect a gaseous fuel source with one of the top burners of the cooking apparatus of FIG. 1.

Therefore, it can be seen that the throttle valve unit 28 that is illustrated in FIGS. 5 and 6 is schematically illustrated as being adapted to interconnect the fuel source 26 to the left rear burner mean 21 of the cooking apparatus 20 with the understanding that the right rear burner means 22, the left front burner means 23 and the right front burner means 24 will have the fuel flow directed thereto by throttle valve units that are identical to the throttle valve unit 28 illustrated in FIGS. 3–6.

Each throttle valve unit 28 of this invention comprises a housing means 29 formed of any suitable material or materials and comprising two sections 30 and 31 that are secured together in any suitable manner with the housing section 30 having an inlet 32 adapted to be fluidly interconnected to the fuel source 26 by a conduit means 33 in a manner conventional in the art and an outlet means 34 adapted to be interconnected to the burner means 21 by a conduit means 35 in a manner conventional in the art.

The housing section 30 of the throttle valve unit 28 has a valve seat 36 separating the inlet 32 from the outlet 34 and having a frusto-conical opening 37 passing therethrough to be opened and closed by a reverse acting frusto-conical movable poppet valve member 38, the valve member 38 and the valve seat 36 being formed of any suitable material or materials, such as the plastic illustrated.

The valve member 38 is urged to a closed condition against the valve seat 36 by a coiled compression spring 39 having one end 40 bearing against the housing section 30 and the other end 41 bearing against the valve member 38.

The poppet valve member 38 has a valve stem 42 that projects not only through the opening 37 of the valve seat 36, but also passes through an opening 43 in a bearing means 44 carried by a bottom wall 45 of the upper housing section 31 so so to be received in a chamber 45' formed in the housing section 31.

The housing section 31 is fluid-sealed to the lower housing section 30 by a sealing gasket means 46 disposed therebetween and has a cover plate 47 sealing closed an open end 48 of an upstanding wall means 49 of the housing section 31 by a sealing gasket means 50 whereby no fuel directed into the throttle valve unit 28 can escape to the exterior thereof except through the outlet 34 thereof.

The throttle valve unit 28 has electrically operated means that is generally indicated by the reference numeral 51 for controlling the position of the valve member 38 relative to the valve seat 36, the electrically operated means 51 comprising a fixed magnet means that is generally indicated by the reference numeral 52 and a movable magnet means that is generally indicated by the reference numeral 53. The magnet means 52 and 53 are each adapted to provide a magnetic field that will react with the other magnetic field so as to position the valve member 38 relative to the valve seat 36.

In particular, the movable magnet means 53 comprises a cylindrical member 54 formed of any suitable electrically insulating material, such as plastic material, and being closed at one end by an end wall means 55 of the electrically insulating material. The stem 42 of the valve member 38 has an externally threaded end 56' threaded into an internally threaded opening 57' of the end wall means 55 of the cylindrical member 54 so as to interconnect the valve member 38 directly to the movable magnet means 53.

The movable magnet means 53 includes an electrical conductor means or insulated conductive wire 56 wound in coil fashion onto the exterior cylindrical surface 57 of the cylindrical member 54 to form an electrical coil 58 that has the opposed ends (not shown) of the conductor means 56 thereof respectively electrically interconnected to electrical leads 59 and 60 that respectively pass out of the chamber 45' of the upper housing section 31 through sealing insulating means 61 and 62 to be electrically interconnected into the electrical circuit means 27 in a manner hereinafter set forth.

In this manner, an electrical current can be passed through the electrical coil 58 to create a magnetic field which reacts with a certain force with the magnetic field that is created by the fixed magnet means 52 in a manner hereinafter set forth to position the valve member 38 relative to the valve seat 36, the force of the magnetic field of the coil 58 being in relation to the magnitude of the electrical current passing therethrough as will be apparent hereinafter whereby the position of the valve member 38 relative to the valve seat 36 is related to the magnitude of the electrical current passing through the coil 58 and, thus, the height of the flame at the burner means 21 is related to the magnitude of the electrical current passing through the coil 58.

The fixed magnet means 52 comprises a cylindrical permanent magnet 63 having a central opening 64 passing therethrough and being of a size to readily permit the coil means 58 to be coaxially received therein in the manner illustrated in FIGS. 5 and 6 whereby at least a part of the coil means 58 is always disposed in the central opening 64 of the magnet means 63 in the particular arrangement of the magnet means 52 and 53 illustrated.

The fixed magnet means 52 also comprises a pair of circular metallic plate-like pole pieces 65 and 66 respectively disposed on opposite sides 67 and 68 of the permanent magnet 63 with the lower pole piece 66 having a central opening 69 passing therethrough to permit the coil means 58 to be received within the central opening 64 of the permanent magnet 63, the upper pole piece 65 of the fixed magnet means 52 carrying a cylindrical rod-like metallic pole piece 70 that is adapted to be received in the open end 71 of the cylindrical member 54 that carries the coil means 58 and thereby permit movement of the coil means 58 relative to the fixed magnet means 52.

As previously stated, the movement of a coil means relative to a fixed magnet means in relation to the magnitude of the electrical current passing through the coil means is a well known means for operating a diaphragm of a speaker unit for a radio or the like and operates on the principle that the magnetic field being created by the electrical current passing through the coil means reacts with the magnetic field of the permanent magnet means so as to drive the coil away from the magnet means as the strength of the magnetic field of the coil means increases and permits the coil means to be moved closer to the fixed magnet means as the force of the magnetic field of the coil means decreases.

The electrically operated means 51 of this invention functions in a similar manner except that the valve member 38 that is interconnected to the coil means 58 is being positioned relative to the valve seat 36 in relation to the magnitude of the electrical current being passed through the coil means 58 under the control of the circuit means 27 hereinafter set forth so as to control the flame height at the burner means 21 being operated by the throttle valve unit 28.

Nevertheless, it can be seen that by accurately controlling the magnitude of the electrical current that is to pass through the coil means 58, the degree of opening of the valve member 38 relative to the valve seat 36 can be accurately controlled and thereby can accurately control the height of the flame 72 being provided at the burner means 21 by the amount of the fuel that is permitted to flow through the throttle valve unit 28.

For example, with no electrical current flowing through the coil means 58, the force of the compression spring 39 is sufficient to close the valve member 38 against the valve seat 36 to prevent any flow of fuel through the throttle valve means 28. However, as the control circuit 27 in a manner hereinafter set forth provides a flow of electrical current through the coil means 58 of a sufficient magnitude so that the resulting magnetic field being created by the flow of electrical current through the conductor means 56 reacts with the magnetic field of the fixed magnet means 52 in a manner to move the coil 58 away from the fixed magnet means 52 and thus force the valve member 38 to an open position relative to the valve seat 36 in opposition to the force of the compression spring 39, the valve member 38 will remain in such particular open position thereof as long as the magnitude of the electrical current continually passing through the coil means 58 remains at that certain amount. Thus, by increasing the magnitude of the electrical current through the conductor means 56 of the magnet means 53, the valve member 38 can be positioned to a new position relative to the valve seat 36 and be held at that new position to provide an increased flow of fuel through the throttle valve means 28.

Therefore, by substantially infinitely controlling the magnitude of the electrical current through the coil means 58 within certain limits the resulting degree of opening of the valve member 38 relative to the valve seat 36 can infinitely control the height of the flame means 72 from a minimum size thereof to a maximum size thereof for the reasons previously set forth whereby the control system 25 of this invention readily permits the operator of the cooking apparatus 20 to individually select the desired height of the flame means at one or more of the burner means 21–24 by utilizing a selector control panel means 73 on the cooking apparatus 20 in a manner hereinafter set forth, the control panel means 73 having seven selector keys 74, 75, 76, 77, 78, 79 and 80 that respectively control seven electrical switches 81, 82, 83, 84, 85, 86 and 87 of the circuit means 27 illustrated in FIG. 7.

The control panel means 73 also includes four indicator lights 88, 89, 90 and 91 which are controlled by the circuit means 27 in a manner well known in the art and thereby are merely indicated by an indicator light box 92 in FIG. 7.

The control panel means 73 also includes an alphanumeric display panel 93 which is also controlled by the circuit means 27 in a manner well known in the art and thereby is merely indicated by the block 93 in FIG. 7.

As illustrated in FIG. 7, an electrical power supply that is normally provided in the building containing the cooking apparatus 20 is indicated by the reference numeral 94 and comprises a source of 120 volt alternating current that is also represented in FIG. 7 by the hot lead L and the neutral lead N, the circuit means 27 being adapted to utilize the electrical power source 94 for operating the throttle valve units 28 of this invention in a manner hereinafter set forth with the throttle valve units 28 being represented in FIG. 7 by the dashed blocks 28 thereof.

The high voltage source 94 can be stepped down by a suitable transformer means and rectified in a manner well known in the art to provide a low voltage direct current power supply for the circuit 27 where needed and such power supply for the circuit 27 is indicated by the block 95 in FIG. 7 which is interconnected by suitable lead means to the fixed contacts of the switches 81–87 while the normally open contacts of the switches 81–87 are interconnected by suitable leads to ground as illustrated. The fixed contacts of the switches 81–87 are respectively interconnected by suitable lead means to a microprocessor 96 whereby the switches 81–87 can each indicate to the microprocess when that particular switch means 81–87 is in a closed condition thereof so that the microprocessor can operate the selected throttle valve means 28 in a manner hereinafter set forth.

Figure 8:
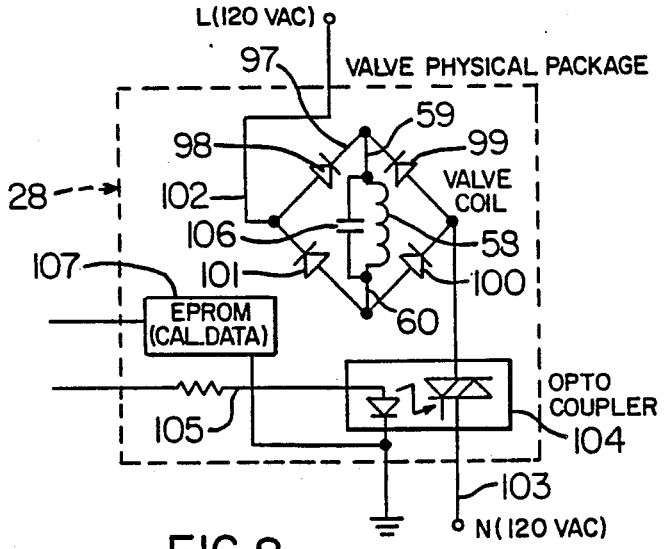
FIG. 8 is an enlarged fragmentary view of part of the electrical circuitry of FIG. 7 that is utilized to control one of the throttle valve units of the control system of the cooking apparatus of FIG. 1.

Since the portion of the electrical circuit 27 for operating each throttle valve means 28 is identical, only the details of one of the portions for one of the throttle valve means 28 is illustrated in FIG. 8 and will now be described.

As illustrated in FIG. 8, the opposed ends of the coil means 58 of the throttle valve unit 28 is adapted to be interconnected by the leads 59 and 60 thereof to a full wave rectifier means that is indicated by the reference numeral 97 and comprises diodes 98, 99, 100 and 101 suitably arranged, the full wave rectifier means 97 being interconnected to the power source lead L by a lead 102 and to the power source lead N by a lead means 103 that has a phototriac 104 therein that is controlled by the microprocessor 96 through a lead means 105 in a manner hereinafter set forth.

A capacitor 106 is disposed in parallel with the coil means 58 for a purpose hereinafter set forth.

In addition, each throttle valve means 28 has an EPROM unit 107 for storing data to permit the microprocessor 96 to calibrate the operation of the particular throttle valve unit 28 being controlled by the triac 104.

Since each electronically modulated gas valve unit 28 requires an electrical excitation which is DC (non-time-varying) in nature, and since it is desired to eliminate unnecessary burden from the electronics' power supply built into the electronic gas valve system 25, each valve unit 28 is driven directly from the 120 VAC power supply L, N through use of a phase firing scheme which requires the phototriac, 104, the full wave rectifier means 97 and capacitor 106 as shown on the drawings. With these components and appropriate signals from the microprocessor 96, the valve unit 28 can be fed differing levels of effective DC excitation.

In particular, it is well known that any triac, once it is turned on (such as by the microprocessor 96) it cannot be turned off until current through the triac is brought to zero. Since the current from the power supply L, N is AC current, this means that the triac 104 will turn off at every zero crossing thereof. Another consequence of this is that the triac 104 must be turned on by the microprocessor 96 twice during each cycle of the AC line voltage—once for the positive half cycle and once for the negative half cycle. Therefore, the percentage of "on time" of a valve unit 28 could be adjusted by the microprocessor 96 by simply turning the triac 104 on later in each half cycle. Conversely, to increase the percentage "on time" of the valve unit 28, the microprocessor 96 must turn on the triac 104 earlier in each half cycle. For a graphic representation of this, see FIGS. 9 and 10.

Figure 9:
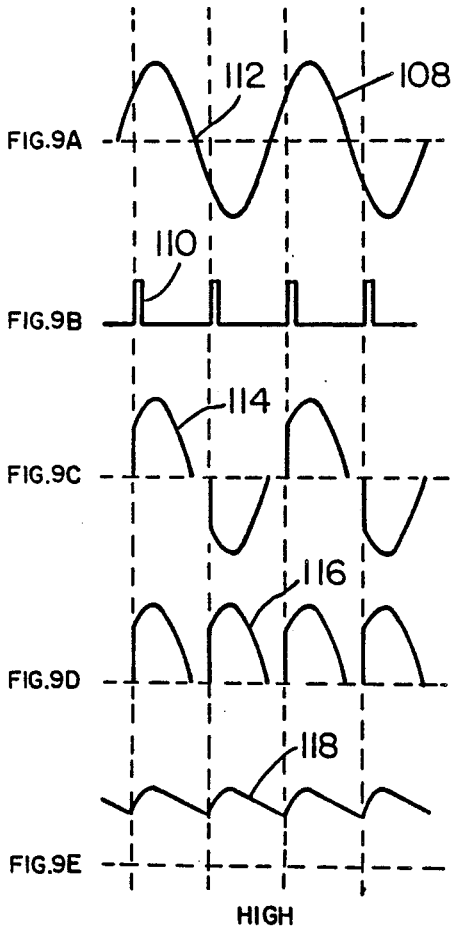
FIG. 9 is a graph that is broken up into parts A, B, C, D and E thereof for indicating the operation of the electrical circuit of one of the throttle valve units of the system of this invention when the same is being operated in a manner for producing a high flame at the burner means being controlled thereby.
Figure 10:
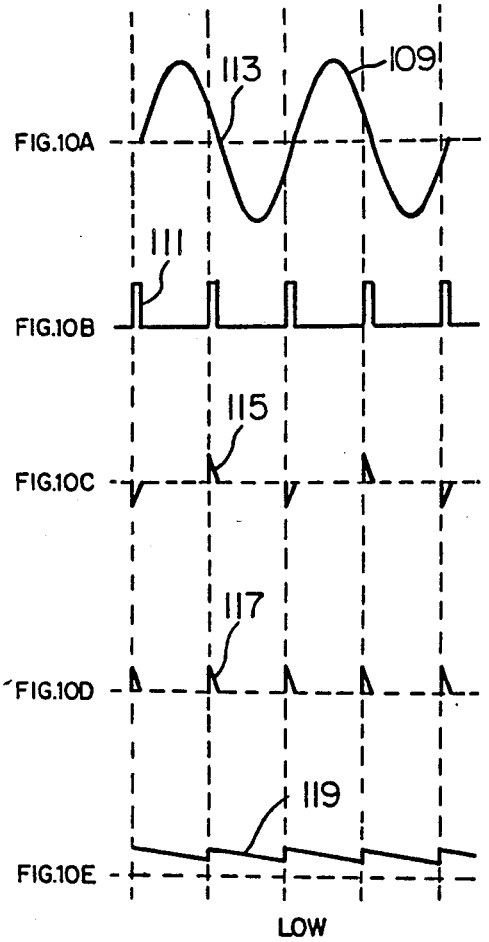
FIG. 10 is a view similar to FIG. 9 and illustrates the operation of the electrical circuit when the throttle valve unit is being operated to provide a low flame at the burner means being controlled thereby.

Relevant waveforms are respectively shown in FIGS. 9 and 10 for high fuel flow and low fuel flow through each electronically modulated gas valve unit 28 with FIG. 9 showing waveforms for the high flow and FIG. 10 showing the waveforms for low flow through the valve unit 28.

Part A of FIGS. 9 and 10 show the incoming sine waves 108 and 109 from the 120 VAC power supply L, N.

Part B of FIGS. 9 and 10 show the turn on pulses 110 and 111 from the microprocessor 96 to the phototriac 104. Note the differing time relationships of the microprocessor's trigger pulses 110 and 111 relative to the zero crossings 112 and 113 of the sine waves 108 and 109 from the AC power supply L, N. It is this time relationship that is the key to adjusting the electrical input to each valve unit 28 and ultimately the gas flow to its respective burner.

Part C of FIGS. 9 and 10 show the waveforms 114 and 115 which would be fed into the valve's full wave rectifier means 97 given the triggering from part B waveforms.

Part D of FIGS. 9 and 10 depict the result of the rectification as waveforms 116 and 117 but without filtering of the capacitors 106.

Part E of FIGS. 9 and 10 show the filtered (via capacitors 106) result as waveform 118 and 119 which is used to energize the valve units 28. Note that the DC or average level is lower in FIG. 10 than in FIG. 9 and this is the parameter that sets the gas flow in the electronically modulated gas valve units 28 of this invention.

Since the design of each valve unit 28 with opposing magnetic fields requires DC excitation, the full wave rectifier means 97 thereof is utilized to "flip-over" the negative half cycle thus making it positive and in agreement with the polarity of the positive half cycle as illustrated by part D in FIGS. 9 and 10. Also, the capacitor 106 is added to provide filtering of the rectified output through additional energy storage, thus maintaining some voltage of the coil 58 of the respective valve unit 28 even during instances that the triac 104 is not energized.

With this basis, one can mathematically show that there is an average (DC) level of excitation which the coil 58 of the respective valve unit 28 sees, and further, the level of that average is a function of the proportion of time during each half cycle that the triac 104 is turned on by the microprocessor 96. Therefore, since the microprocessor 96 can vary the "on time" of the triac 104, it also varies the average DC voltage seen by the valve unit 28. This in turn varies the position of the valve's mechanism and ultimately results in a controlled level of gas flow.

This scheme is also known as "phase firing" because the time interval that the triac 104 is on during each half line cycle is usually referred to as a "conduction angle"

with the time relationship between the triac's firing pulse (from the microprocessor 96) and the peak of the AC power supply's waveform being sometimes referred to as a "phase angle." This scheme requires the microprocessor 96 to know the magnitude as well as phase of the line voltage from the AC power supply 94 and such data knowledge is well known in the art. For example, see the U.S. Pat. No. 4,745,515 to Daniel L. Fowler, whereby this patent is being incorporated into this disclosure by this reference thereto. With that data, the microprocessor 96 will be able to correctly fire the triac 104 to maintain constant flame height at the burner no matter what the magnitude of the line voltage.

Thus, it can be seen that the operator of the system 25 of this invention through the use of the control panel 73 can effectively set the microprocessor 96 as hereinafter set forth to turn on the triac 104 a set time period before each zero cross of the waveform of the power source 94 occurs that will turn off the triac 104 so that the magnitude of the resultant electrical current that flows through the coil means 58 of the selected throttle valve unit 28 will be constant and produce a flame height at its respective burner means 21, 22, 23 or 24 that is related to that particular magnitude because the degree of opening of the valve member 38 thereof relative to the valve seat 36 thereof is directly related to the magnitude of the electrical current flowing through the coil means 58.

Therefore, it can be seen that the fuel control system 25 of this invention can be formed of the various parts thereof by the method of this invention in the manner previously set forth to operate in a manner now to be described.

When the operator desires to turn on one of the burner means 21–24, such as the left rear burner means 21, the operator first pushes the selector on-off key 74 and, if the switch means 81 thereof is held closed for the required time interval, the microprocessor 96 will cause the indicator light 88 to flash so that the operator will now know that the operation of the burner means 21 has been properly selected and that by now either pressing the adjust lower key 78 or the adjust higher key 79, the burner means 21 will have fuel directed thereto that will be ignited by suitable igniter means (not shown) and will be at the highest flame height thereof as the microprocessor 96 will, upon the initial operation of the key 78 or key 79, cause the maximum current amount to flow through the coil means 58 of the throttle valve unit 28 for the burner means 21. At this time the light 88 stops flashing and remains on until the burner 21 is turned off. However, the operator can then lower the flame height by pushing in on the selector key 78 to close switch 85 and holding the same in its closed condition to cause the microprocessor 96 to decrease the magnitude of the effective electrical current flowing through the coil means 58 (by setting the turn on time of the respective triac 104 closer to the zero cross of the waveform of the power source 94) to an amount that positions the valve member 38 thereof relative to the valve seat 36 thereof to a position that will provide the desired flame height at the burner means 21 whereby the adjust lower key 78 is released by the operator at such point. The microprocessor 96 also operates the display 93 in a manner to continuously indicate the fuel flow amount being selected to the user. In this manner, the microprocessor 96 will maintain the selected flame height at the burner means 21 until the operator turns off the burner means 21 by either pressing the left rear on-off key 74 or pressing the all off key 80 as previously set forth. Of course, the operator can readjust the flame height of the burner means 21 by using the selector key 78 or 79 should the initial setting not be desired.

In this manner, it can be seen that the operator can select one or more of the burner means 21–24 for operation thereof and serially set the desired height of the flame means thereof through the use of the selector keys 74–79 in the manner previously described.

Therefore, it can be seen that the system 25 of this invention requires a two-step turn on sequence before a burner means 21, 22, 23 or 24 can be operated. For example, the user must first press one of the "on/off" buttons or keys 74, 75, 76 or 77 and then press either the "increase flow" or "decrease flow" button or key 78 or 79 before a time expires in order to open one of the gas valve units 28. This feature circumvents accidental turning on of the gas valves from bumping of the buttons and other possible mishaps.

Also, it can be seen that the electronic gas valve system 25 of this invention operates in a mode which will be referred to as "slewing." That is, once the flame is ignited the system responds only to commands of the user to increase or decrease the flow of gas to the burner. In reality, the user serves as a feedback loop of the valve flow, slewing the flow higher and lower until desired flame characteristics are achieved. This type of operation gives the user essentially infinite capability of flow adjustment and it allows considerable simplification of the electronic design of the control circuitry.

The electronic gas valve system 25 of this invention includes an "all off" button or key 80. Pressing the "all off" button or key 80 at any time during the operation of the appliance will immediately cause all gas flow to the top burners 21–24 to be shut off. Consider for example a situation in which one or more of the cooking utensils currently on the stove are boiling over. In the panic associated with such a situation, the consumer need only press the "all off" button or key 80 and all gas flow stops. Consider another situation in which all four burners 21–24 are being used to prepare a meal and, with good planning, all the food being prepared on the top burners 21–24 should be done cooking at the same time. To turn off gas to each of the burners 21–24, one can simply press the "all off" button or key 80 and with one action turn off each and every burner. Added convenience is afforded by this feature—in both cases one button need be pressed instead of several to turn off the burners. Of course, the burners can be turned off individually by the keys 74–77 if desired.

Since the programming of the microprocessor 96 to function in response to the keys 74–80 in the above manner to produce the results desired is well known in the art, a further discussion of the operation of the various parts of the circuit 27 of this invention as illustrated in FIG. 7 is deemed unnecessary.

However, it is to be understood that fuel flow versus electrical input data for each throttle valve unit 28 can be stored in its respective read-only memory device 107 of FIG. 7. Thus, each throttle valve 28 will have its particular characteristics read by the associated electronic control means at every power-up of the system 25. In this way, the control system 25 will have sufficient data to compensate for performance differences arising from mass production tolerances of the valve unit's design so that, in effect, the overall system 25 would then be self-calibrating even to the point of automatically compensating for valve units 28 requiring field replacement.

It is also to be understood that structurally, each valve unit 28 could be modified from the form thereof that has been illustrated and still function in the desired manner as previously set forth.

For example, while a spring 39 is provided for valve closure, a coil-magnet interaction arrangement could be provided. Also, while a movable coil 58 and a fixed permanent magnet means 52 are provided for each valve unit 28, the magnet could be the movable member that is secured to the valve member 38 and the coil could act as the stator therefor. An additional modification would be the replacement of the permanent magnet means 52 with a suitable electrically operated magnet arrangement.

Therefore, it can be seen that this invention not only provides a new fuel control system and method of making the same, but also this invention provides a new throttle valve unit and method of making the same.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control system for controlling a throttle valve unit for interconnecting a source of fuel to a burner means, said throttle valve unit having a movable valve member and a valve seat controlled by said valve member, said throttle valve unit having electrically operated means operatively associated with said valve member to control the position of said valve member relative to said valve seat so as to control the flame height at said burner means, said electrically operated means comprising a fixed magnet means and a movable magnet means each of which is adapted to provide a magnetic field that will react with the other magnetic field, one of said magnet means having electrical conductor means that is adapted to vary the force of its said magnetic field in relative to the magnitude of an electrical current passing therethrough whereby said valve member is adapted to be positioned relative to said valve seat in relation to the effect created between said magnetic fields, said system comprising means for generating an electrical current signal from a source of alternating electrical current and for passing said electrical current signal through said electrical conductor means so as to position said valve member relative to said valve seat in relation to the magnitude of said electrical current signal, said means for generating said signal having means for converting said alternating current to an effective direct current flow and passing that effective direct current flow through said electrical conductor means, the improvement wherein said means for converting comprises a full wave rectifier means that places said electrical conductor means across said alternating current source and a capacitor means in parallel with said electrical conductor means, said means for generating said signal comprising a triac in series with said rectifier means and being adapted to interconnect said rectifier means across said alternating current source each time said triac is turned on and to disconnect said rectifier means from across said alternating current source each time said alternating current source has a zero crossing.

2. A system as set forth in claim 1 wherein said means for generating said signal is adapted to substantially infinitely change said magnitude of said electrical current signal within certain limits thereof.

3. A system as set forth in claim 1 wherein said means for generating said signal comprises a microprocessor that is operatively interconnected to said triac to turn on said triac twice in each full wave cycle of said alternating current source.

4. A system as set forth in claim 3 wherein said means for generating said signal comprises selector means operatively interconnected to said microprocessor to cause said triac to turn on at a selected point in each half wave cycle of said alternating current source.

5. A system as set forth in claim 4 wherein said selector means is adapted to be operated so as to cause said selected point in each half wave cycle to be substantially infinitely adjustable.

6. A system as set forth in claim 1 wherein said means for generating said signal comprises selector means operatively interconnected to said triac to turn on said triac twice in each full wave cycle of said alternating current source.

7. A system as set forth in claim 6 wherein said selector means is adapted to select the point in each half wave cycle of said alternating current source that said triac is to turn on in advance of the next zero crossing of said alternating current source.

8. A system as set forth in claim 7 wherein said selector means is adapted to be operated so as to cause the selected said point in each half wave cycle of said alternating current source to be substantially infinitely adjustable between the two zero crossings of said alternating current source that are on the two ends of that respective half wave cycle.

* * * * *